US011247248B1

(12) United States Patent
Fuller

(10) Patent No.: US 11,247,248 B1
(45) Date of Patent: Feb. 15, 2022

(54) FAKE EYELASH CLEANING ASSEMBLY

(71) Applicant: Leslie Fuller, Mansfield, TX (US)

(72) Inventor: Leslie Fuller, Mansfield, TX (US)

( * ) Notice: Subject to any disclaimer, the term of this patent is extended or adjusted under 35 U.S.C. 154(b) by 0 days.

(21) Appl. No.: 17/108,073

(22) Filed: Dec. 1, 2020

(51) Int. Cl.
*B08B 3/12* (2006.01)
*B08B 7/04* (2006.01)
*A41G 5/02* (2006.01)

(52) U.S. Cl.
CPC ..... *B08B 3/12* (2013.01); *B08B 7/04* (2013.01); *A41G 5/02* (2013.01)

(58) Field of Classification Search
CPC combination set(s) only.
See application file for complete search history.

(56) References Cited

U.S. PATENT DOCUMENTS 3,491,775 A 1/1970 Aylott
6,338,350 B1 * 1/2002 Ewen ..... G02C 13/006 134/102.3
6,719,850 B2 4/2004 Glucksman
7,207,342 B1 * 4/2007 Daniels ..... B08B 3/02 134/111
7,448,398 B2 * 11/2008 Glucksman ..... B08B 3/12 134/117
9,468,287 B1 10/2016 Barnard
D796,749 S 9/2017 Kessler
10,362,823 B1 7/2019 Hill
2014/0096801 A1 4/2014 McCormick

FOREIGN PATENT DOCUMENTS

WO WO03059538 7/2003

* cited by examiner

*Primary Examiner* — Erin F Bergner

(57) ABSTRACT

A fake eyelash cleaning assembly includes a cleaning tank for containing a cleaning solution thereby facilitating fake eyelashes to be submerged in the cleaning solution for cleaning. An ultrasonic emitter is integrated into the cleaning tank to emit ultrasonic sound waves into the cleaning solution for dislodging makeup from the fake eyelashes to clean the fake eyelashes. Additionally, the cleaning tank is supported on a housing. A first drawer is slidably integrated into the housing and the first drawer is foraminous to pass air therethrough. A blower is positioned within the housing to blow air into the first drawer for drying the fake eyelashes when the fake eyelashes are positioned in the first drawer. A second drawer is slidably integrated into the housing to store the fake eyelashes when they have been dried.

16 Claims, 5 Drawing Sheets

FAKE EYELASH CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cleaning devices and more particularly pertains to a new cleaning device for cleaning fake eyelashes.

(2) Description of Related Art Including Information Disclosed Under 37 CFR 1.97 and 1.98

The prior art relates to cleaning devices including a case for storing fake eyelashes and which includes a brush for cleaning the fake eyelashes. The prior art discloses a sonic cleaner for cleaning jewelry. The prior art discloses a cosmetic brush cleaner that may employ ultrasonic cleaning.

BRIEF SUMMARY OF THE INVENTION

An embodiment of the disclosure meets the needs presented above by generally comprising a cleaning tank for containing a cleaning solution thereby facilitating fake eyelashes to be submerged in the cleaning solution for cleaning. An ultrasonic emitter is integrated into the cleaning tank to emit ultrasonic sound waves into the cleaning solution for dislodging makeup from the fake eyelashes to clean the fake eyelashes. Additionally, the cleaning tank is supported on a housing. A first drawer is slidably integrated into the housing and the first drawer is foraminous to pass air therethrough. A blower is positioned within the housing to blow air into the first drawer for drying the fake eyelashes when the fake eyelashes are positioned in the first drawer. A second drawer is slidably integrated into the housing to store the fake eyelashes when they have been dried.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
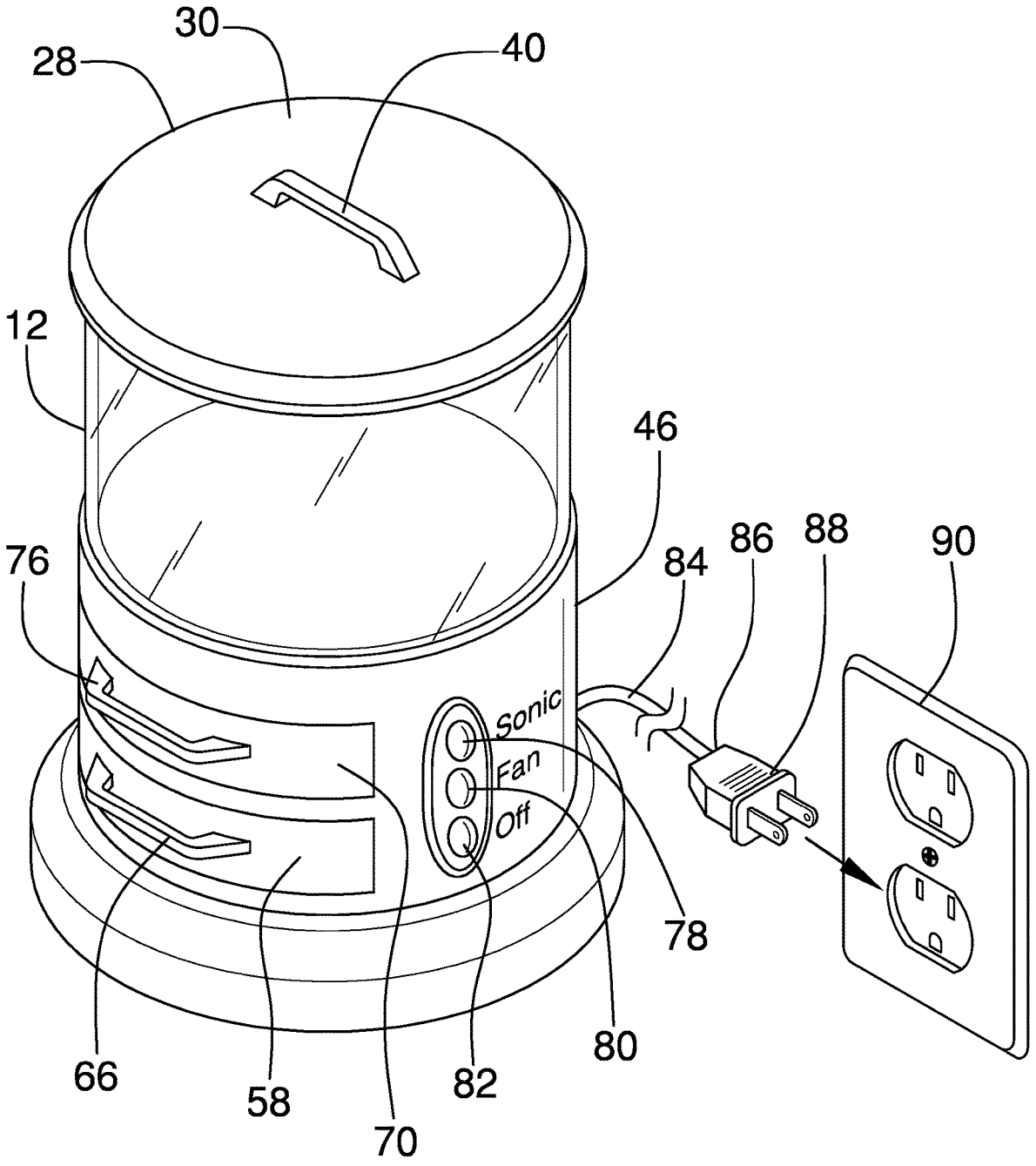
FIG. 1 is a front perspective view of a fake eyelash cleaning assembly according to an embodiment of the disclosure.
Figure 2:
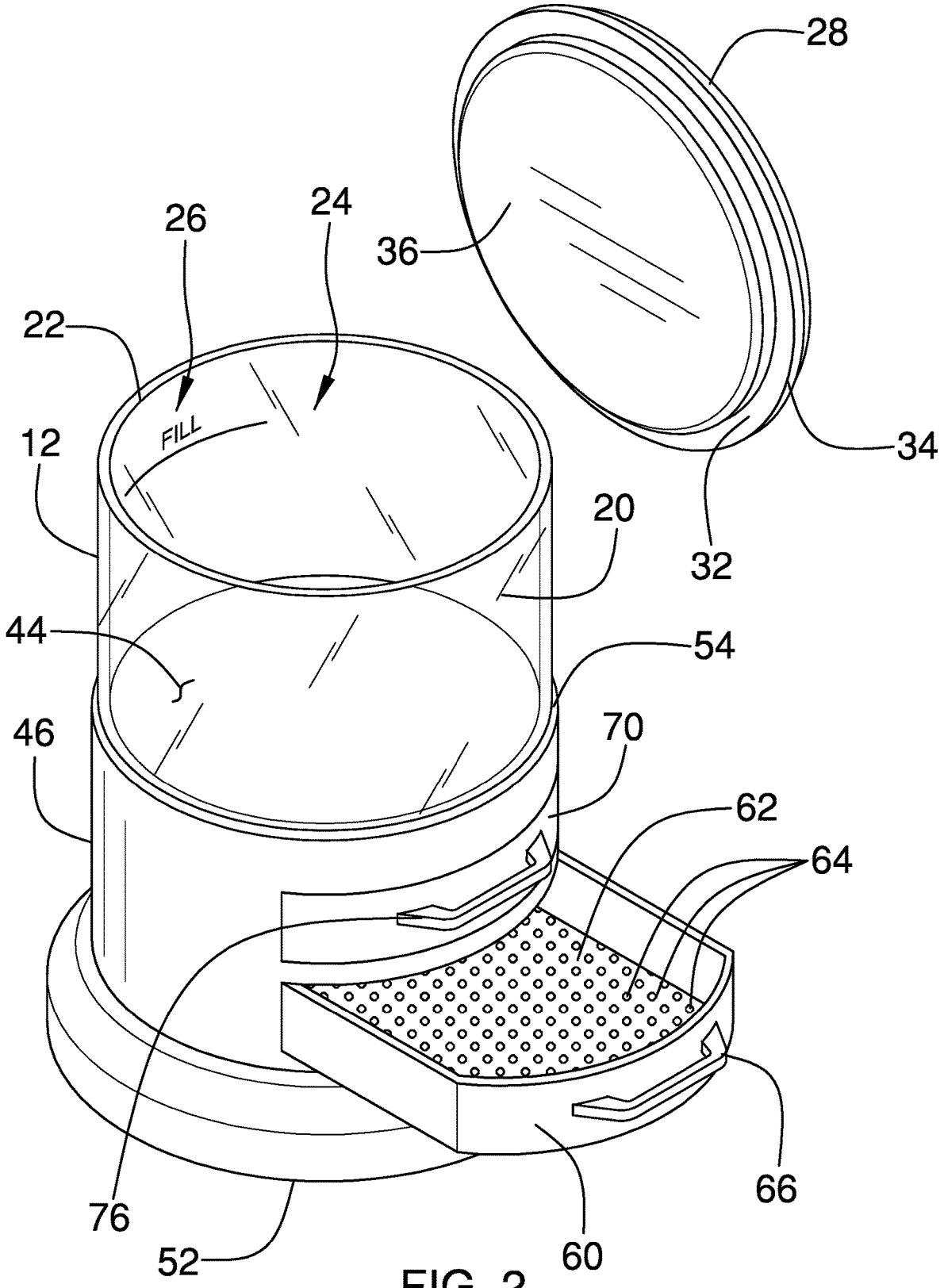
FIG. 2 is a perspective view of an embodiment of the disclosure showing a first drawer in an open position.
Figure 3:
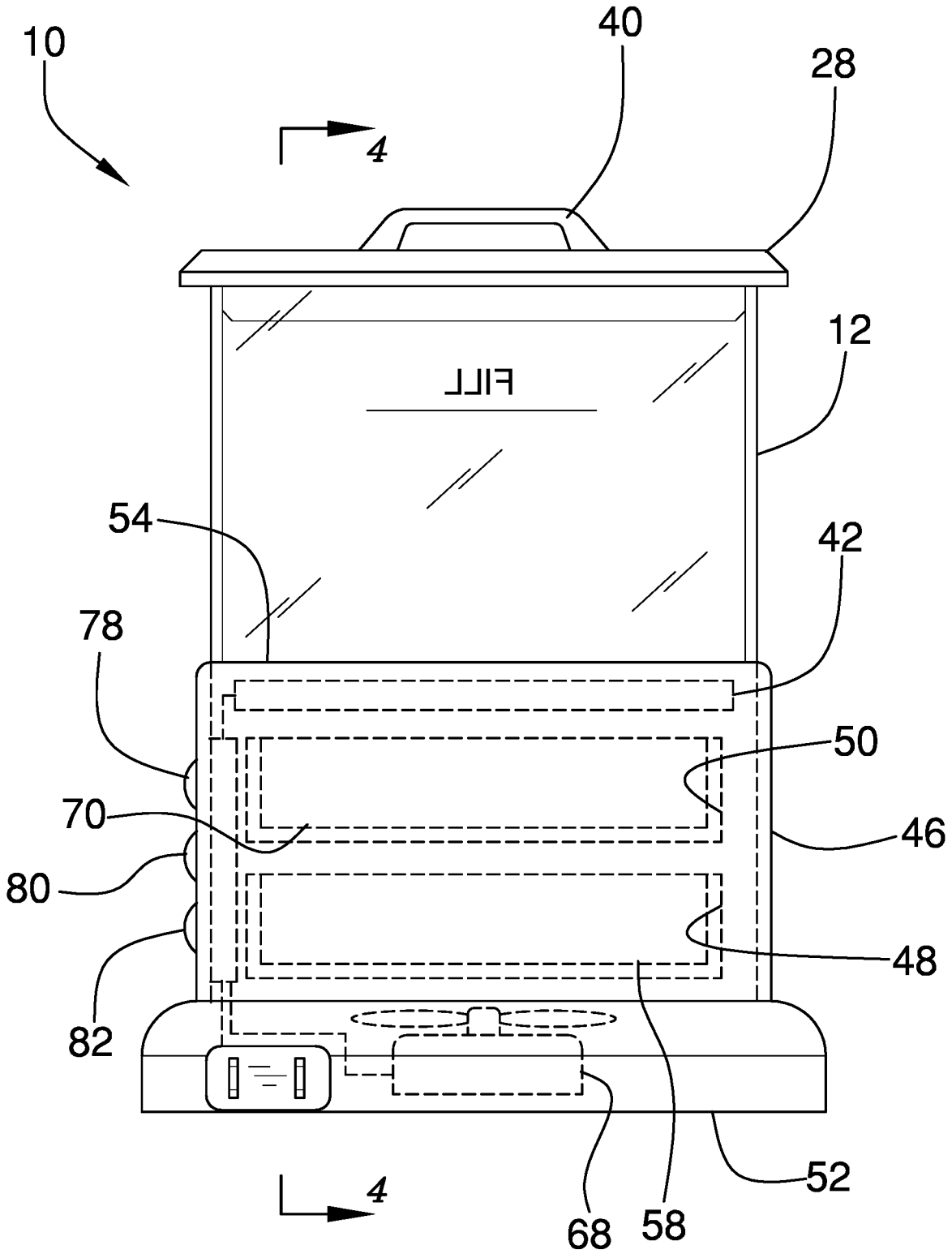
FIG. 3 is a left side phantom view of an embodiment of the disclosure.
Figure 4:
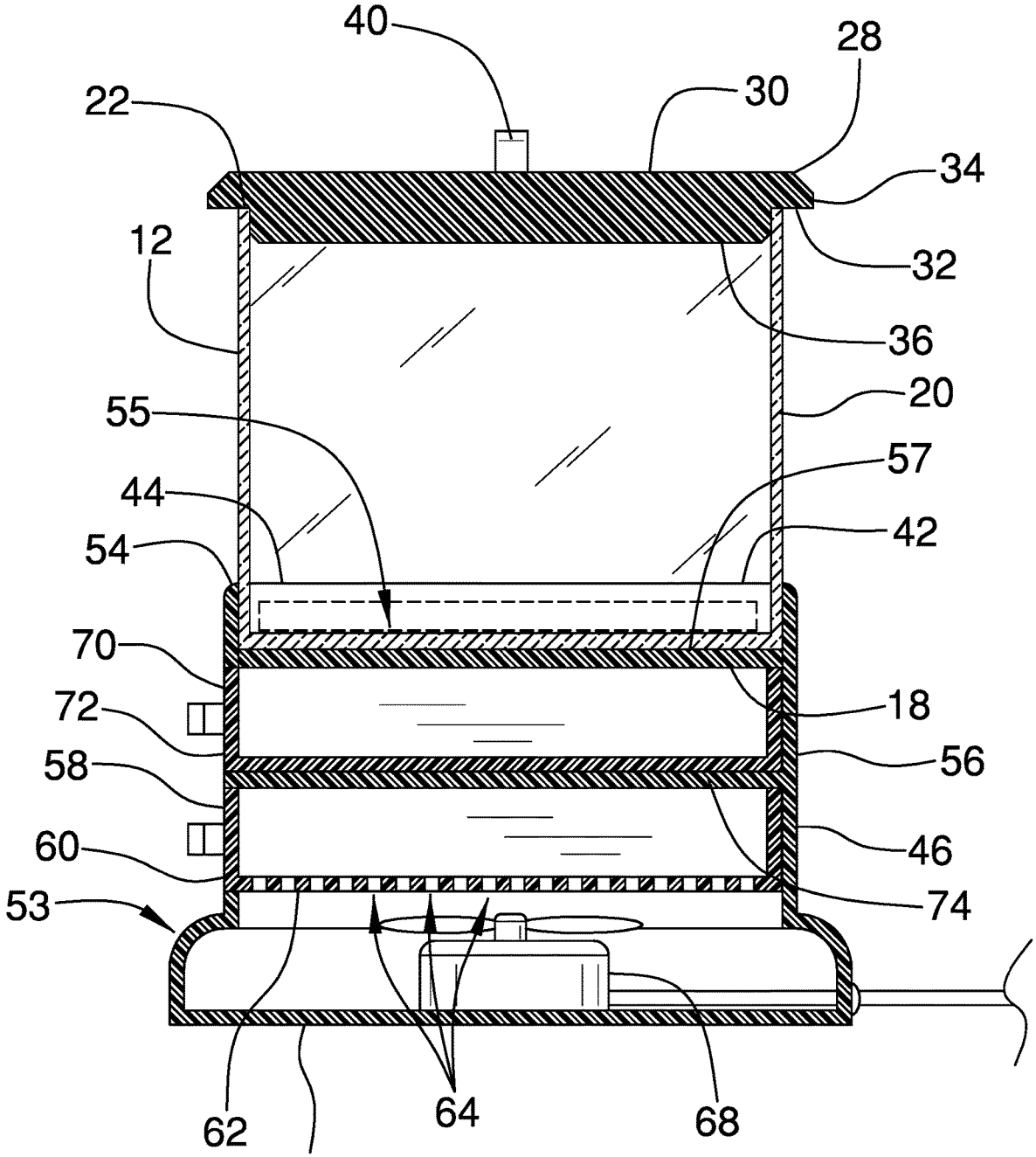
FIG. 4 is a cross sectional view taken along line 4-4 of FIG. 3 of an embodiment of the disclosure.
Figure 5:
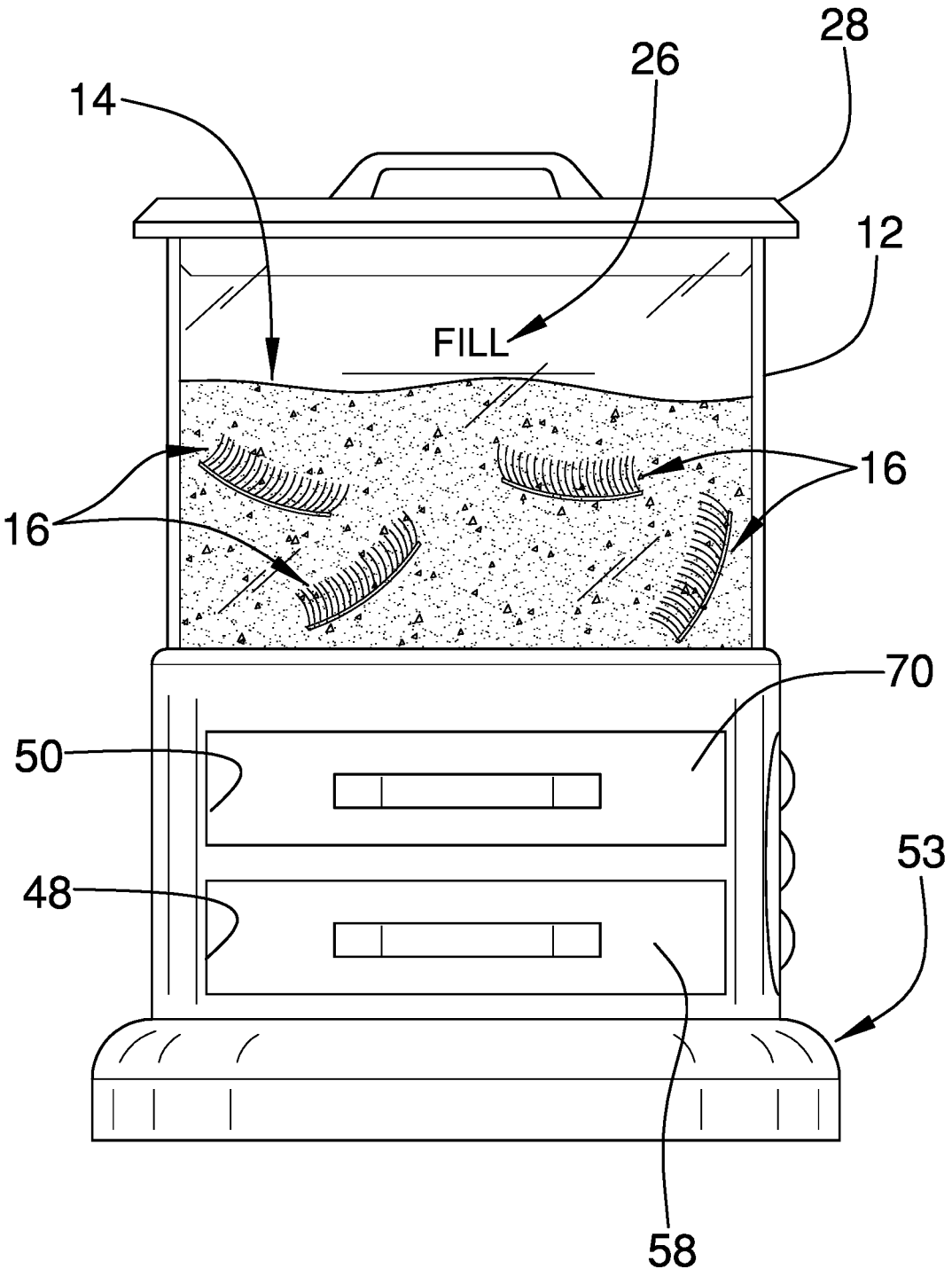
FIG. 5 is a front view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the fake eyelash cleaning assembly 10 generally comprises a cleaning tank 12 is that can contain a cleaning solution 14 thereby facilitating fake eyelashes 16 to be submerged in the cleaning solution 14 for cleaning the fake eyelashes 16. The cleaning solution 14 may be a fluid cleaning solution that is approved for cleaning fake eyelashes 16, and the fake eyelashes 16 may be cosmetic eyelashes of any conventional design. The cleaning tank 12 is comprised of a translucent material to facilitate the cleaning solution 14 and the fake eyelashes 16 to be visible therethrough. The cleaning tank 12 has a bottom wall 18 and an outer wall 20 extending upwardly therefrom, and the outer wall 20 has a distal edge 22 with respect to the bottom wall 18 to define an opening 24 into the cleaning tank 12. The outer wall 20 has indicia 26 printed thereon comprising a maximum fill line that is spaced from the distal edge 22.

A lid 28 is provided that has top side 30, a bottom side 32 and a perimeter edge 34 extending therebetween. The bottom side 32 has a prominence 36 extending downwardly therefrom and an outer threshold 38 of the prominence 36 is spaced from the perimeter edge 34. The bottom side 32 rests on the distal edge 22 of the outer wall 20 of the cleaning tank 12 having the distal edge 22 being positioned between the outer threshold 38 of the prominence 36 and the perimeter edge 34 of the lid 28. In this way the lid 28 is inhibited from sliding off of the cleaning tank 12. A lid handle 40 is coupled to and extends upwardly from the top side 30 for gripping to install or remove the lid 28.

An ultrasonic emitter 42 is integrated into the cleaning tank 12 to emit ultrasonic sound waves into the cleaning solution 14. In this way the ultrasonic emitter 42 can dislodge makeup from the fake eyelashes 16 to clean the fake eyelashes 16. The ultrasonic emitter 42 is integrated into the bottom wall 18 of the cleaning tank 12 and the ultrasonic emitter 42 has a top surface 44 that is exposed in an interior of the cleaning tank 12. In this way the top surface 44 is in contact with the cleaning solution 14 when the cleaning solution 14 is poured into the cleaning tank 12. The ultrasonic emitter 42 may comprise an electronic ultrasonic disk or other similar device that is capable of emitting vibration frequencies ranging between approximately 0.8 MHz and 2.5 MHz.

A housing 46 is provided and the cleaning tank 12 is supported thereon. The housing 46 has a first slot 48 integrated therein and the housing 46 has a second slot 50 integrated therein. The housing 46 has a basal wall 52, an upper wall 54 and an outside wall 56 extending therebetween. The upper wall 54 has a recess 55 extending downwardly therein for receiving the cleaning tank 12 having the bottom wall 18 of the cleaning tank 12 resting on a lower bounding surface 57 of the recess 55. The outside wall 56 is continuously arcuate about a center point of the basal wall 52 such that the housing 46 has a cylindrical shape.

Each of the first slot 48 and the second slot 50 extends through the outer wall 20 into an interior of the housing 46. The first slot 48 is positioned adjacent to the basal wall 52 and the second slot 50 is positioned between the first slot 48 and the upper wall 54. Each of the first slot 48 and the second slot 50 is elongated to extend along an axis is oriented parallel with the basal wall 52. The outside wall 56 has a flared portion 53 that flares outwardly adjacent to the basal wall 52 such that the basal wall 52 has a diameter that is greater than a diameter of the upper wall 54 to inhibit the housing 46 from tipping laterally.

A first drawer 58 is slidably integrated into the first slot 48 and the fake eyelashes 16 can be positioned therein when the fake eyelashes 16 have been cleaned. The first drawer 58 is foraminous to facilitate air to pass therethrough. The first drawer 58 has a front wall 60 and a lower wall 62, and the lower wall 62 has a plurality of openings 64 each extending therethrough such that the lower wall 62 facilitates the foraminous quality of the first drawer 58. The front wall 60 is curved such that the front wall 60 conforms to curvature of the outside wall 56 of the housing 46 when the first drawer 58 is closed. A first handle 66 is coupled to and extends away from the front wall 60 of the first drawer 58 for gripping to open and close the first drawer 58.

A blower 68 is positioned within the housing 46 and the blower 68 is aligned with the first drawer 58 to blow air into the first drawer 58 for drying the fake eyelashes 16 positioned in the first drawer 58. The blower 68 is positioned between the basal wall 52 of the housing 46 and the lower wall 62 of the first drawer 58. In this way the blower 68 can blow air through each of the openings 64 in the lower wall 62 of the first drawer 58 when the blower 68 is turned on. The blower 68 may comprise an electric motor and a fan that is rotatably coupled to the electric motor.

A second drawer 70 is slidably integrated into the second slot 50 and the fake eyelashes 16 can be positioned in the second drawer 70 when the fake eyelashes 16 have been dried in the first drawer 58. In this way the fake eyelashes 16 can be stored for use in the future. The second drawer 70 has a front wall 72 and a lower wall 74, and the front wall 72 of the second drawer 70 is curved such that the front wall 72 of the second drawer 70 conforms to curvature of the outside wall 56 of the housing 46 when the second drawer 70 is closed. A second handle 76 is coupled to and extends away from the front wall 72 of the second drawer 70 for gripping to open and close the second drawer 70.

A sonic button 78 is movably integrated into the outer wall 20 of the housing 46 such that the sonic button 78 can be manipulated by a user. The sonic button 78 is electrically coupled to the ultrasonic emitter 42 for tuning the ultrasonic emitter 42 on. A blower button 80 is movably integrated into the outer wall 20 of the housing 46 such that the blower button 80 can be manipulated by the user. The blower button 80 is electrically coupled to the blower 68 for turning the blower 68 on. An off button 82 is movably integrated into the outer wall 20 of the housing 46 such that the off button 82 can be manipulated by the user. The off button 82 is electrically coupled to each of the ultrasonic emitter 42 and the blower 68 for turning each of the ultrasonic emitter 42 and the blower 68 off.

A power cord 84 is coupled to and extends away from the housing 46, and the power cord 84 is electrically coupled to each of the ultrasonic emitter 42 and the blower 68. The power cord 84 has a distal end 86 with respect to the housing 46 and a male plug 88 is electrically coupled to the distal end 86. Moreover, the male plug 88 can be plugged into a power source 90 comprising a female electrical outlet.

In use, the cleaning tank 12 is filled with a pre-determined volume of the cleaning solution 14 and the fake eyelashes 16 are submerged in the cleaning solution 14. The lid 28 is placed on the cleaning tank 12 and the sonic button 78 is depressed to turn on the ultrasonic emitter 42. In this way the ultrasonic emitter 42 vibrates the cleaning solution 14 for effectively dislodging makeup and other contaminants from the fake eyelashes 16. The fake eyelashes 16 are removed from the cleaning tank 12 when the fake eyelashes 16 are sufficiently cleaned and the fake eyelashes 16 are positioned in the first drawer 58.

The blower 68 is turned on to blow air into the first drawer 58 for drying the fake eyelashes 16. Additionally, the fake eyelashes 16 are removed from the first drawer 58 and are positioned in the second drawer 70 for storage when the fake eyelashes 16 are sufficiently dried. In this way the fake eyelashes 16 can be employed multiple times without requiring new fake eyelashes 16 to be purchased.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fake eyelash cleaning assembly for cleaning, drying and subsequently storing fake eyelashes for repeated use, said assembly comprising:

a cleaning tank being configured to contain a cleaning solution thereby facilitating fake eyelashes to be submerged in the cleaning solution for cleaning the fake eyelashes, said cleaning tank being comprised of a translucent material wherein said cleaning tank is configured to facilitate the cleaning solution and the fake eyelashes to be visible therethrough;

an ultrasonic emitter being integrated into said cleaning tank wherein said ultrasonic emitter is configured to emit ultrasonic sound waves into the cleaning solution for dislodging makeup from the fake eyelashes to clean the fake eyelashes;

a housing having said cleaning tank being supported thereon, said housing having a first slot being integrated therein, said housing having a second slot being integrated therein;

a first drawer being slidably integrated into said first slot wherein said first drawer is configured to have the fake eyelashes positioned therein when the fake eyelashes have been cleaned, said first drawer being foraminous wherein said first drawer is configured to pass air therethrough;

a blower being positioned within said housing, said blower being aligned with said first drawer wherein said blower is configured to blow air into said first drawer for drying the fake eyelashes positioned in said first drawer; and a second drawer being slidably integrated into said second slot wherein said second drawer is configured to have the fake eyelashes positioned therein when the fake eyelashes have been dried in said first drawer.

2. The assembly according to claim 1, wherein said cleaning tank has a bottom wall and an outer wall extending upwardly therefrom, said outer wall having a distal edge with respect to said bottom wall to define an opening into said cleaning tank, said outer wall having indicia being printed thereon comprising a maximum fill line being spaced from said distal edge.

3. The assembly according to claim 2, wherein said ultrasonic emitter is integrated into said bottom wall of said cleaning tank, said ultrasonic emitter having a top surface being exposed in an interior of said cleaning tank wherein said top surface is configured to be in contact with the cleaning solution when the cleaning solution is poured into said cleaning tank.

4. The assembly according to claim 2, wherein said housing has a basal wall, an upper wall and an outside wall extending therebetween, said upper wall having a recess extending downwardly therein for receiving said cleaning tank having said bottom wall of said cleaning tank resting on a lower bounding surface of said recess, said outside wall being continuously arcuate about a center point of said basal wall such that said housing has a cylindrical shape.

5. The assembly according to claim 4, wherein each of said first slot and said second slot extends through said outer wall into an interior of said housing, said first slot being positioned adjacent to said basal wall, said second slot being positioned between said first slot and said upper wall, each of said first slot and said second slot being elongated to extend along an axis being oriented parallel with said basal wall.

6. The assembly according to claim 4, wherein said outside wall has a flared portion flaring outwardly adjacent to said basal wall such that said basal wall has a diameter being greater than a diameter of said upper wall to inhibit said housing from tipping laterally.

7. The assembly according to claim 4, wherein said first drawer has a front wall and a lower wall, said lower wall having a plurality of opening each extending therethrough such that said lower wall facilitates said foraminous quality of said first drawer, said front wall being curved such that said front wall conforms to curvature of said outside wall of said housing when said first drawer is closed.

8. The assembly according to claim 7, further comprising a first handle being coupled to and extending away from said front wall of said first drawer wherein said first handle is configured to be gripped for opening and closing said first drawer.

9. The assembly according to claim 7, wherein said blower is positioned between said basal wall of said housing and said lower wall of said first drawer wherein said blower is configured to blow air through each of said openings in said lower wall of said first drawer when said blower is turned on.

10. The assembly according to claim 4, wherein said second drawer has a front wall and a lower wall, said front wall of said second drawer being curved such that said front wall of said second drawer conforms to curvature of said outside wall of said housing when said second drawer is closed.

11. The assembly according to claim 10, further comprising a second handle being coupled to and extending away from said front wall of said second drawer wherein said second handle is configured to be gripped for opening and closing said second drawer.

12. The assembly according to claim 4, further comprising a sonic button being movably integrated into said outside wall of said housing wherein said sonic button is configured to be manipulated by a user, said sonic button being electrically coupled to said ultrasonic emitter for tuning said ultrasonic emitter on.

13. The assembly according to claim 4, further comprising a blower button being movably integrated into said outside wall of said housing wherein said blower button is configured to be manipulated by the user, said blower button being electrically coupled to said blower for turning said blower on.

14. The assembly according to claim 2, further comprising an off button being movably integrated into said outside wall of said housing wherein said off button is configured to be manipulated by the user, said off button being electrically coupled to each of said ultrasonic emitter and said blower for turning each of said ultrasonic emitter and said blower off.

15. The assembly according to claim 1, further comprising a power cord being coupled to and extending away from said housing, said power cord being electrically coupled to each of said ultrasonic emitter and said blower, said power cord having a distal end with respect to said housing, said distal end having a male plug being electrically coupled thereto wherein said male plug is configured to be plugged into a power source comprising a female electrical outlet.

16. A fake eyelash cleaning assembly for cleaning, drying and subsequently storing fake eyelashes for repeated use, said assembly comprising:

a cleaning tank being configured to contain a cleaning solution thereby facilitating fake eyelashes to be submerged in the cleaning solution for cleaning the fake eyelashes, said cleaning tank being comprised of a translucent material wherein said cleaning tank is configured to facilitate the cleaning solution and the fake eyelashes to be visible therethrough, said cleaning tank having a bottom wall and an outer wall extending upwardly therefrom, said outer wall having a distal edge with respect to said bottom wall to define an opening into said cleaning tank, said outer wall having indicia being printed thereon comprising a maximum fill line being spaced from said distal edge;

an ultrasonic emitter being integrated into said cleaning tank wherein said ultrasonic emitter is configured to emit ultrasonic sound waves into the cleaning solution for dislodging makeup from the fake eyelashes to clean the fake eyelashes, said ultrasonic emitter being integrated into said bottom wall of said cleaning tank, said ultrasonic emitter having a top surface being exposed in an interior of said cleaning tank wherein said top surface is configured to be in contact with the cleaning solution when the cleaning solution is poured into said cleaning tank;

a housing having said cleaning tank being supported thereon, said housing having a first slot being integrated therein, said housing having a second slot being integrated therein, said housing having a basal wall, an upper wall and an outside wall extending therebetween, said upper wall having a recess extending downwardly therein for receiving said cleaning tank having said bottom wall of said cleaning tank resting on a lower bounding surface of said recess, said outside wall being continuously arcuate about a center point of said basal wall such that said housing has a cylindrical shape, each of said first slot and said second slot extending through said outer wall into an interior of said housing, said first slot being positioned adjacent to said basal wall, said second slot being positioned between said first slot and said upper wall, each of said first slot and said second slot being elongated to extend along an axis being oriented parallel with said basal wall, said outside wall having a flared portion flaring outwardly adjacent to said basal wall such that said basal wall has a diameter being greater than a diameter of said upper wall to inhibit said housing from tipping laterally;

a first drawer being slidably integrated into said first slot wherein said first drawer is configured to have the fake eyelashes positioned therein when the fake eyelashes have been cleaned, said first drawer being foraminous wherein said first drawer is configured to pass air therethrough, said first drawer having a front wall and a lower wall, said lower wall having a plurality of opening each extending therethrough such that said lower wall facilitates said foraminous quality of said first drawer, said front wall being curved such that said front wall conforms to curvature of said outside wall of said housing when said first drawer is closed;

a first handle being coupled to and extending away from said front wall of said first drawer wherein said first handle is configured to be gripped for opening and closing said first drawer;

a blower being positioned within said housing, said blower being aligned with said first drawer wherein said blower is configured to blow air into said first drawer for drying the fake eyelashes positioned in said first drawer, said blower being positioned between said basal wall of said housing and said lower wall of said first drawer wherein said blower is configured to blow air through each of said openings in said lower wall of said first drawer when said blower is turned on;

a second drawer being slidably integrated into said second slot wherein said second drawer is configured to have the fake eyelashes positioned therein when the fake eyelashes have been dried in said first drawer, said second drawer having a front wall and a lower wall, said front wall of said second drawer being curved such that said front wall of said second drawer conforms to curvature of said outside wall of said housing when said second drawer is closed;

a second handle being coupled to and extending away from said front wall of said second drawer wherein said second handle is configured to be gripped for opening and closing said second drawer;

a sonic button being movably integrated into said outside wall of said housing wherein said sonic button is configured to be manipulated by a user, said sonic button being electrically coupled to said ultrasonic emitter for tuning said ultrasonic emitter on;

a blower button being movably integrated into said outside wall of said housing wherein said blower button is configured to be manipulated by the user, said blower button being electrically coupled to said blower for turning said blower on; and an off button being movably integrated into said outside wall of said housing wherein said off button is configured to be manipulated by the user, said off button being electrically coupled to each of said ultrasonic emitter and said blower for turning each of said ultrasonic emitter and said blower off; and a power cord being coupled to and extending away from said housing, said power cord being electrically coupled to each of said ultrasonic emitter and said blower, said power cord having a distal end with respect to said housing, said distal end having a male plug being electrically coupled thereto wherein said male plug is configured to be plugged into a power source comprising a female electrical outlet.

* * * * *